United States Patent [19]

Kulisz, Sr. et al.

[11] Patent Number: 4,925,761

[45] Date of Patent: May 15, 1990

[54] CONVERSION SOLUTIONS FOR LITHOGRAPHIC PRINTING PLATES CONTAINING PHYTIC ACID

[75] Inventors: Michael Kulisz, Sr., Roselle; Robert N. Cooper, Northbrook, both of Ill.

[73] Assignee: A. B. Dick, Chicago, Ill.

[21] Appl. No.: 366,680

[22] Filed: Jun. 15, 1989

[51] Int. Cl.[5] ..... G03G 13/26

[52] U.S. Cl. ..... 430/97; 106/2; 430/104; 430/331

[58] Field of Search ..... 106/2; 430/104, 331, 430/97

[56] References Cited

U.S. PATENT DOCUMENTS

| | | | |
|---|---|---|---|
| 4,530,721 | 7/1985 | Kinderman | 430/331 X |
| 4,734,132 | 3/1988 | Yoshida | 106/2 |
| 4,762,771 | 8/1988 | Matsumoto | 430/309 X |
| 4,834,797 | 5/1989 | Toyofuku | 430/104 X |

*Primary Examiner*—J. David Welsh

*Attorney, Agent, or Firm*—Leydig, Voit & Mayer

[57] ABSTRACT

A cyanide-free desensitizing or conversion solution for converting imaged electrophotographic masters to lithographic printing plates comprising:

(a) from about 1.0 to about 3.0 percent of phytic acid;

(b) from about 0.5 to about 2 percent of a water-soluble anionic polymer;

(c) from about 1.0 to about 3.0 percent of a water-soluble dibasic acid; and (d) an aqueous carrier; all percentages being based upon the total weight of the solution, the pH of said solution ranging from about 3.5 to about 6.0.

A method of using this solution to convert imaged masters is also disclosed.

24 Claims, No Drawings

CONVERSION SOLUTIONS FOR LITHOGRAPHIC PRINTING PLATES CONTAINING PHYTIC ACID

FIELD OF THE INVENTION

The present invention relates to a cyanide-free conversion or desensitizing solution for use in converting an electrophotographic substrate or master into a printing plate or master copysheet useful in planographic or lithographic printing and to a method for treating such an electroptotographic master to increase the hydrophilicity of the background, or nonimage, areas of such a master to render it useful as a printing plate or master copy sheet.

BACKGROUND OF THE INVENTION

Lithographic or planographic printing employs an offset printing plate to produce printed images. Such a plate may be a sheet of paper, plastic base or other suitable substrate which has a hydrophobic image region and a hydrophilic nonimage or background region. The image area is wetted during the printing process by a lithographic printing ink, while the hydrophilic background (nonimage) areas repel and are not wetted by the ink. Typically, the offset printing plate is formed from an electrophotographic master which has a light-sensitive layer comprising fine particles of a photoconductive material (e.g., zinc oxide) dispersed in a resin binder. The electrophotographic master is subjected to a conventional process to form a hydrophobic image on the light-sensitive layer.

After the completion of the electrophotographic operation, the master is transformed into a crude offset printing plate, or master copy sheet, comprising a somewhat water wettable nonimage area (hydrophilic area) and a poorly water wettable image area (hydrophobic area). However, since the entire surface of the electrophotographic master is originally a hydrophobic photoconductive layer, even after completion of the electrophotographic operation, the background (non-image) areas on the plate initially remain partially hydrophobic in nature. Thus, if the plate were used immediately, the printing ink would also adhere to the nonimage, background areas, resulting in unsatisfactory quality of the printed products. It is therefore necessary to render the nonimage areas of the master hydrophilic (and to remove any hydrophobic properties) by "converting" or "desensitizing" it before printing.

Desensitizing or conversion solutions (also called "etching solutions") that have been proposed to date may be classified into two types, one type being a cyanide compound containing solution, usually comprising a ferrocyanate (as described in U.S. Pat. No. 3,001,872) or ferricyanate, and the other type being a cyanide-free solution, usually comprising an amine cobalt complex (as described in U.S. Pat. No. 4,208,212), pnytic acid (as described in U.S. Pat. No. 3,592,640 and Japanese Patent Publication No. 2839/83) or its derivative, or a guanidine derivative.

However, none of the aforementioned processing solutions have been found to be completely satisfactory. Although the first type of solution containing a ferricyanate or ferrocyanate has the advantages of high desensitizing power, ability to form a strong hydrophilic film, and fast film formation, such a cyanide-containing solution suffers from several significant problems. Because the ferrocyanide or ferricyanide ion is somewhat photosensitive and heat sensitive, when it is exposed to light, it undergoes either a color forming reaction or a precipitation reaction that weakens the desensitizing power of the solution. More significantly, however, the cyanide ions present in such formulations lead to the formation of detectable free cyanide in the waste effluent from the conversion process which, if not properly treated, may pollute water-courses and cause other environmental concerns.

Two examples of this type of cyanide-containing solutions are provided by U.S. Pat. Nos. 3,764,353 and 3,211,686. The '353 patent discloses a desensitizing, or conversion, solution that contains a ferrocyanide or ferricyanide salt, a polybasic organic or inorganic acid such as succinic acid, a polyvalent metallic salt such as salts containing phosphate, and a chelating agent. The chelating agent assists in retaining metallic ions, such as inorganic phosphates, in solution. The agent accomplishes the solubilization by chelating with the metallic ions, and thus preventing precipitation of compounds such as inorganic phosphate salts while also stabilizing the ion containing cyanide.

The '686 patent illustrates a solution which comprises essentially an aqueous solution having an alkali metal ferrocyanide or ferricyanide and an organic film-forming material such as polyacrylic acid. In addition, a buffering agent, such as trisodium phosphate, is introduced to adjust the pH of the solution to a value within the range of about 3.0 to about 7.25.

However, and despite the ability of the aforementioned solutions to desensitize photoelectrographic masters, they are undesirable in that they are comprised of cyanide-containing compounds.

As indicated previously, cyanide-free conversion solutions have been proposed to eliminate the problems associated with such cyanide-containing solutions. Unfortunately, the cyanide-free desensitizing solutions employed to date have been unable to produce completely satisfactory lithographic printing plates or copy masters. Particularly, the cyanide-free solutions have resulted in a slower rate of hydrophilic film formation than the prior cyanide compound-containing solutions, and have not been capable of forming an immediately printable, hydrophilic film of sufficiently high physical strength after only one pass through an etch processor. As a result, scum often forms on the nonimage area or insufficient edge acuity of halftone dots is present.

Phytic acid (inositol hexaphosphate) esters and metal derivatives thereof have been known to form chelate compounds with metals, and previously have been proposed for use as desensitizers in the processing of the offset printing master as described in U.S. Pat. No. 3,592,640. However, these compounds have such a slow film forming rate that the desired hydrophilic film is not obtainable by a single pass through the processor and may often cause scum on the nonimage area or insufficient edge acuity of halftone dots.

In previously filed Japanese Patent Publication No. 5799/83, use has been proposed of an ion complex of a water-soluble cationic polymer and a mono- or divalent metal salt of an inositol hexaphosphate ester (e.g., sodium phytate, potassium phytate or calcium phytate). This complex has improved water retention but does not achieve a satisfactory etching speed. At the same time, the complex is highly dependent on moisture and is so sensitive to the printing environment that scum easily forms on the nonimage area during printing at low humidity.

In U.S. Pat. No. 4,579,591 there is disclosed a conversion solution which includes (a) at least one member selected from the group of ammonium and amine salts of a phytic acid ester, (b) a low molecular weight electrolyte, and (c) a water-soluble cationic polymer. According to that patent, an ion complex is formed between the water-soluble cationic polymer and the ammonium or amine salt of the phytic acid ester, which acts as the active species in the formulation.

Despite the development of the various cyanide-free conversion formulations, as discussed above, none have attained widespread commercial acceptance because of their inability to achieve sufficiently satisfactory results in comparison with the cyanide-containing formulations. Therefore, a need remains for a cyanide-free formulation having desensitizing properties substantially equal to such formulations which do contain cyanide compounds.

SUMMARY OF THE INVENTION

There has now been discovered a conversion solution comprising:

(a) from about 1.0 to about 3.0 percent of phytic acid;

(b) from about 0.5 to about 2.0 percent of a water-soluble anionic polymer;

(c) from about 1.0 to about 3.0 percent of a water-soluble, dibasic acid; and (d) an aqueous carrier, all percentages being based on the total weight of the solution, the pH of said solution ranging from about 3.5 to about 6.0.

Surprisingly, the present invention also provides a method for increasing the hydrophilicity of nonimage areas of an exposed, electrophotographic master. The method comprises contacting said master with a conversion solution comprising:

(a) from about 1 to about 3 percent of phytic acid;

(b) from about 0.5 to about 2 percent of a water-soluble anionic polymer;

(c) from about 1 to about 3 percent of a water-soluble, dibasic acid; and (d) an aqueous carrier; all percentages being based upon the total weight of the formulation, the pH of said solution ranging from about 3.5 to about 6.0.

DETAILED DESCRIPTION OF THE INVENTION

The conversion solution of the present invention provides a printing master that can be processed at high speed without causing scum on the nonimage area or insufficient edge acuity in halftone dots.

The desensitizing solution in accordance with the present invention comprises an aqueous solution of phytic acid, a water-soluble anionic polymer, and a water-soluble dibasic acid, and has a pH ranging from about 3.5 to about 6.0. For the purposes of brevity, it should be understood that all remaining percentages refer to percent by weight of solution.

The phytic acid component is present in the solution from about 1.0 to about 3.0 percent, and preferably about 2.0 percent. It has been discovered that although a greater percentage of phytic acid may be employed in this type of solution, use of an amount over about 8.0 percent results in initial image deteriorization, or blinding, due to the at least partial conversion (hydrophilization) of the image area.

The water-soluble dibasic acid and water-soluble anionic polymer, when combined with the phytic acid in amounts ranging from about 1.0 to about 3.0 percent, preferably 2.0 percent, and from about 0.5 to about 2.0 percent, preferably 1.0 percent, respectively, result in the solution exhibiting vastly superior desensitizing characteristics over those cyanide-free solutions presently available. More specific information as to these properties and characteristics may be found in the Examples which follow.

The dibasic acid component, while preferably succinic acid, may also include alkanoic acids such as adipic, malonic, succinic, fumaric and the like, as well as substituted alkanoic acids such as citric acid. Inorganic acids which may be employed include mineral acids, such as nitric, sulfuric, hydrochloric and the like.

Suitable examples of the anionic polymer contemplated by the present invention are water soluble compounds having molecular weights in the range of from about 10,000 to about 500,000 and having infinite dilutability with water. More specifically, polyacrylic acid and polymethacrylic acid such as Rohm & Haas Acrysols, are acceptable polymers, with polyacrylic arid having a molecular weight ranging from about 60,000 to about 500,000 being preferred. While it may be advantageous to increase the amount of this component due to its hydrophilicity, such an increase will also result in an undesirable increase in solution viscosity. However, by using an anionic polymer having a lower molecular weight, this disadvantage can be circumvented. In this way, the beneficial effects associated with increased levels of polymer in the solution may be experienced without increasing the viscosity of the solution.

The balance of the solution, which is generally aqueous in nature, comprises water, preferably deionized water.

The conversion solution may further contain various additives such as a pH modifier (e.g., organic or inorganic acids or a basic hydroxide such as potassium hydroxide and sodium hydroxide), a pH buffer (e.g., phosphates), a wetting agent, or humectant, which ensures that the master remains moist during subsequent processing (e.g., ethylene glycol, sorbitol, glycerin or gum arabic), and an antiseptic (e.g., salicylic acid, phenol, butylparabenzoate, or sodium dehydroacetate or 6-acetoxy-2,4 dimethyl-m-dioxane). The conversion solution of the present invention is preferably used at a pH in the range of from about 3.5 to 6, most preferably at a pH of about 5.0. In addition to its use as a conversion solution, the present solution may also be diluted with water for use as dampening water.

In producing the solution, the order of addition of the respective components is not critical; however, it is preferred that the acidic components be added to the buffering system.

The additives referred to in the preceding paragraph are preferably present in the solution in predetermined amounts. Specifically, the wetting agent, which is preferably glycerine, may be present in an amount of from about 2.0 to about 10.0 percent, preferably about 6.0 percent. As alluded to earlier, this agent acts principally as a humectant, keeping the master moist while the master is transported from the conversion solution applicator to the press. This effect is desirable even if the conversion is completed after the electrophotographic master is mounted on the printing machine because a uniformly moist master produces copies possessing a clean background.

The pH buffer, preferably trisodium phosphate, should be present in an amount of from about 0.5 to about 10.0 percent, optimally about 2.6 percent. If use of the antiseptic in the solution is desired, an amount ranging from about 0.1 to about 0.15 percent, preferably 0.11 percent, should be added to the solution. The antiseptic imparts microbiocidal action to the solution.

Finally, it should be recognized that, despite the aforementioned limits, the pH buffer may be added to the solution in any amount, this amount being limited only by the desirability of maintaining the solution at the previously identified pH. Further, the pH buffer, when added to the solution, has a second function in that it acts to form a complex with the zinc ions present during conversion of the copy sheet, this serving to improve the background characteristics of the copies produced by the press. An additional advantage of the present solution is that the use of a rust inhibitor is not required.

Thus, it is seen that the cyanide-free conversion solution of the present invention has the following advantages: it does not contain ferrocyanide or ferricyanide that is an environmental hazard and which is deteriorated by light or heat; it can be stored for an extended period without causing discoloration or precipitation; it is less sensitive to the printing environment than the prior art cyan free solution; and it has such an improved film forming speed that it can be subjected to fast etching for making an offset printing master having no scum on the nonimage area or which is free from insufficient edge acuity of halftone dots. Further, the cyanide-free conversion solution of the present invention is also useful as the etching solution or dampening solution for the lithographic plate prepared from the conventional presensitized lithographic plate, i.e., the lithographic printing plate comprising the aluminum support having a lithographically suitable light-sensitive layer applied thereon.

An additional aspect of the present invention is a method for using the novel desensitizing solution described previously. Although the process of converting an electrophotographic master to an offset printing plate, or master copy sheet, is well known in the art and was described in a preceding section of this disclosure, it will be recited herein for purposes of completeness.

Initially, it is necessary to select an electrophotographic master. Such electrophotographic recording materials or masters which are especially suited to be used in the preparation of a planographic printing plate are described, e.g., in the United Kingdom Patent Specifications Nos. 1,125,580 and 1,125,579, and U.S. Pat. No. 4,456,670.

After the selection is made, the desired image must be formed on the master. Any known process for forming the electrostatic latent image and hydrophobic image may be applied. According to a common technique the hydrophobic image is formed by the consecutive steps of producing an electrostatic image on a photoconductive zinc oxide/hydrophobic binder layer by integrally electrostatically charging that layer and subsequently imagewise exposing and then developing the latter with a hydrophobic developer powder which is fixed to the recording layer, e.g., by heating.

The powder image can be formed by the known dry "carrier-toner development" or by a liquid development based on electrophoresis wherein charged hydrophobic particles are attracted from an electrically insulating liquid to the charged areas of the recording layer. Such development technique is described, e.g., in the U.K. Patent Specification No. 755,486.

Subsequent to the formation of the image, the master is transformed into a crude printing plate which must be converted or desensitized before use. The actual converting is a relatively simple process which requires that the conversion solution be in contact with the master for a time sufficient to render the nonimage areas of the master hydrophilic, or more properly, non-hydrophobic.

According to one embodiment, the electrophotographic imaged master is rendered water receptive at the areas to be hydrophilized after the printing master has been mounted on the press, thus obviating the need for any separate immersion treatment. The hydrophilizing treatment of said layer may be carried out by means of an absorbent pad impregnated with the conversion solution of this invention.

After the conversion is completed, the resulting plate may be rinsed with water and printing using the newly completed plate may commence.

The present invention is hereunder described in greater detail by reference to the following example.

EXAMPLE

| EXAMPLE | |
|---|---|
| Components | Percent by weight of solution |
| Deionized water | 84.90 |
| Trisodium phosphate (crystal) | 2.60 |
| Sodium hydroxide | 1.38 |
| Succinic acid | 1.99 |
| Phytic acid | 1.99 |
| Acrysol A-3 (Polyacrylic acid) | 1.06 |
| Givauden DXN (6-acetoxy-2, 4-dimethyl-m-dioxane) (microbicide) | 0.11 |
| Glycerine | 5.97 |
| | 100.00 |

The components listed above were mixed one ingredient at a time in the order indicated by the list, in a clean container using an air mixer. The final product ("Example I") had a pH of about 5.0 and a specific gravity of approximately 1.06.

This formula may also be used as a fountain concentrate by diluting it with deionized water. The proper ratio is one ounce of the above formula with thirty one ounces of water, this producing one quart of the final fountain concentrate. Mixing was accomplished by hand.

In order to see the effects of the key ingredients on desensitizing performance, each of the principal ingredients listed above was systematically deleted, leaving the other ingredients intact in the formula (Comparative Examples A, B, and C, respectively). In addition, less of the NaOH and trisodium phosphate were added in order to adjust for pH differences.

"Over-dosing" tests were also included to show desensitization results when too much of certain key ingredients are used (Comparative Examples D, E, and F, respectively). Electrophotographic plates having coating types 1435, 1400 and 1200 were included because they are the coatings normally used in commercial applications. Types 1435 and 1400 normally produce 5000 copies and Type 1200 is rated at 2500 copies. Test results with regard to the copies obtained under various parameters using the products of Example I, Comparative Examples A–F, and a commercially available cyanide-containing formulation are illustrated in the following Table.

TABLE

| Formula No. | Type | 1435 Results[1] | 1400 Results[1] | 1200 Results[2] | Remarks |
|---|---|---|---|---|---|
| Commercial Cyanide Containing | Ferrocyanide Base | good & clean | good & clean | good & clean | Pass |
| I | Phytic acid Base | good & clean | good & clean | good & clean | Pass |
| A | I without phytic acid | Black copy | Black copy | Black copy | No conversion |
| B | I without polyacylic acid only | unacceptable background | unacceptable background | unacceptable background | Incomplete conversion |
| C | I without succinic acid only | gray background | slight background | very slight background | Incomplete conversion |
| D | I with 7% succinic acid | image is undercut after 3500 copies | image is undercut after 3500 copies | good & clean | unacceptable on 1435 & 1400 |
| E | I with 12% phytic acid | initial blinding | initial blinding | initial blinding | unacceptable |
| F | I with 10% polyacrylic acid | — | — | — | Caused 20–20 ink to emulsify |

[1]5000 copy run.
[2]2500 copy run.

While the invention has been described in detail and with reference to specific embodiments thereof, it will be apparent to one skilled in the art that various changes and modifications can be made therein without departing from the spirit and scope thereof.

We claim as our invention:

1. A cyanide-free conversion or desensitizing solution for use in printing comprising:
(a) from about 1.0 to about 3.0 percent of phytic acid;
(b) from about 0.5 to about 2 percent of a water-soluble anionic polymer;
(c) from about 1.0 to about 3.0 percent of a water-soluble dibasic acid; and
(d) an aqueous carrier;
all percentages being based on the total weight of the solution, the pH of said solution ranging from about 3.5 to about 6.0.

2. The desensitizing solution of claim 1, wherein said water-soluble anionic polymer is selected from the group consisting of polyacrylic acid, polymethacrylic acid, alkali metal salts of polyacrylic acids, alkali metal salts of polymethacrylic acids, ammonium salts of polyacrylic acids, ammonium salts of polymethacrylic acids, and mixtures thereof.

3. The desensitizing solution of claim 2, wherein said water-soluble anionic polymer has a molecular weight of from about 10,000 to about 500,000.

4. The desensitizing solution of claim 2, wherein said water-soluble dibasic acid is selected from the group consisting of succinic acid, adipic acid, and oxalic acid.

5. The desensitizing solution of claim 1, wherein said water-soluble anionic polymer is polyacrylic acid.

6. The desensitizing solution of claim 5, wherein said water-soluble dibasic acid is succinic acid.

7. The desensitizing solution of claim 1, further comprising a pH modifier selected from the group consisting of organic acids, inorganic acids, and basic hydroxides.

8. The desensitizing solution of claim 7, wherein said pH modifier is sodium hydroxide.

9. The desensitizing solution of claim 7, further comprising a pH buffer selected from the group consisting of phosphates.

10. The desensitizing solution of claim 9, wherein said pH buffer is trisodium phosphate.

11. The desensitizing solution of claim 9, further comprising a wetting agent selected from the group consisting of ethylene glycol, sorbitol, glycerine, gum arabic, and mixtures thereof.

12. The desensitizing solution of claim 11, wherein said wetting agent is glycerine.

13. The desensitizing solution of claim 11, further comprising an antiseptic selected from the group consisting salicylic acid, phenol, butylparabenzoate, sodium dehydroacetate, 6-acetoxy-2,4 dimethyl-m-dioxane, and mixtures thereof.

14. The desensitizing solution of claim 13, wherein said antiseptic is 6-acetoxy-2,4 dimethyl-m-dioxane.

15. The desensitizing solution of claim 1, wherein said phytic acid is about 4.0 percent by weight of solution, said dibasic acid is succinic acid being about 2.0 percent by weight of solution, and said anionic polymer is polyacrylic acid being about 4.3 percent by weight of solution.

16. The desensitizing solution of claim 7, wherein said pH modifier is present in an amount sufficient to adjust the pH of the solution within the range of about 3.0 to about 6.5.

17. The desensitizing solution of claim 8, wherein said sodium hydroxide is about 1.4 percent by weight of solution.

18. The desensitizing solution of claim 9, wherein said pH buffer is present from about 0.5 to about 10.0 percent by weight of solution.

19. The desensitizing solution of claim 10, wherein said trisodium phosphate is about 2.6 percent by weight of solution.

20. The desensitizing solution of claim 11, wherein said wetting agent is present from about 2.0 to about 10.0 percent by weight of solution.

21. The desensitizing solution of claim 12, wherein said glycerine is about 6.0 percent by weight of solution.

22. The desensitizing solution of claim 13, wherein said antiseptic is present from about 0.10 to about 0.15 percent by weight of solution.

23. The desensitizing solution of claim 14, wherein said 6-acetoxy-2,4 dimethyl-m-dioxane is about 0.11 percent by weight of solution.

24. A method for converting electrophotographic masters to lithographic printing plates comprising contacting a master copy sheet with a desensitizing solution comprising:
(a) from about 1.0 to about 3.0 percent of phytic acid;
(b) from about 0.5 to about 2 percent of a water-soluble anionic polymer;
(c) from about 1.0 to about 3.0 percent of a water-soluble dibasic acid; and
(d) an aqueous carrier; all percentages being based upon the total weight of the solution, the pH of said solution ranging from about 3.5 to about 6.0.

* * * * *